US009595250B2

(12) United States Patent
Ierymenko

(10) Patent No.: US 9,595,250 B2
(45) Date of Patent: Mar. 14, 2017

(54) HANDHELD VIBRATION CONTROL DEVICE FOR MUSICAL INSTRUMENTS

(71) Applicant: Paul Ierymenko, Asheville, NC (US)

(72) Inventor: Paul Ierymenko, Asheville, NC (US)

( * ) Notice: Subject to any disclaimer, the term of this patent is extended or adjusted under 35 U.S.C. 154(b) by 0 days.

(21) Appl. No.: 15/003,301

(22) Filed: Jan. 21, 2016

(65) Prior Publication Data

US 2016/0217778 A1 Jul. 28, 2016

Related U.S. Application Data

(60) Provisional application No. 62/106,438, filed on Jan. 22, 2015.

(51) Int. Cl.
*G10H 3/14* (2006.01)
*G10H 3/26* (2006.01)
*G10H 3/18* (2006.01)

(52) U.S. Cl.
CPC ..... *G10H 3/26* (2013.01); *G10H 3/181* (2013.01); *G10H 3/186* (2013.01); *G10H 2220/165* (2013.01)

(58) Field of Classification Search
CPC ..... G10H 3/26; G10H 3/181; G10H 3/186; G10H 2220/165; G10H 2220/191; G10D 3/00
USPC ..... 84/727
See application file for complete search history.

(56) References Cited

U.S. PATENT DOCUMENTS 4,064,781 A * 12/1977 Fals ..... G10D 3/163 84/322
4,075,921 A * 2/1978 Heet ..... G10H 3/26 84/738
4,171,659 A * 10/1979 Tumminaro ..... G10H 3/181 84/315
4,235,144 A * 11/1980 Lubow ..... G10H 1/06 84/322
4,387,621 A * 6/1983 Franzmann ..... G10H 3/18 84/735
4,941,388 A * 7/1990 Hoover ..... G10H 3/26 84/726
5,070,759 A * 12/1991 Hoover ..... G10H 3/18 84/726
5,105,711 A * 4/1992 Barnard ..... G10H 3/18 84/737
5,300,730 A * 4/1994 Ekhaus ..... G10D 3/163 84/320
5,449,858 A * 9/1995 Menning ..... G10H 3/26 84/727
5,693,904 A * 12/1997 Kihneman ..... G10H 3/181 84/725
5,864,083 A * 1/1999 Caren ..... G10H 1/46 84/322

(Continued)

*Primary Examiner* — Jeffrey Donels
(74) *Attorney, Agent, or Firm* — Myers Bigel, P.A.

(57) ABSTRACT

A handheld device for controlling a vibration of a resonant musical member of a musical instrument includes a handheld housing; at least one transducer on the housing that is configured to sense a proximity and/or vibration of a resonant musical member and output an actuating vibratory electromagnetic force based on the vibration of the resonant musical member; and a haptic component on the housing that is configured to output a tactile feedback responsive to a location and/or vibration of a resonant musical member.

25 Claims, 7 Drawing Sheets

(56) References Cited

U.S. PATENT DOCUMENTS

| | | | | |
|---|---|---|---|---|
| 6,216,059 | B1 * | 4/2001 | Ierymenko | G10H 3/181 700/280 |
| 6,242,676 | B1 * | 6/2001 | Romero | G10D 3/00 84/315 |
| 6,946,592 | B1 * | 9/2005 | Chick | G10D 3/163 84/322 |
| 9,147,382 | B2 * | 9/2015 | Holm | G10D 3/163 |
| 2003/0053643 | A1 * | 3/2003 | Bank | H04R 1/028 381/152 |
| 2005/0145100 | A1 * | 7/2005 | Ramstein | G10H 1/32 84/645 |
| 2016/0049142 | A1 * | 2/2016 | Radmacher | G10H 3/181 84/726 |

* cited by examiner

HANDHELD VIBRATION CONTROL DEVICE FOR MUSICAL INSTRUMENTS

RELATED APPLICATIONS

This application claims priority to U.S. Provisional Application Ser. No. 62/106,438, filed Jan. 22, 2015, the disclosure of which is hereby incorporated by reference in its entirety.

FIELD OF THE INVENTION

The present invention relates to motion and vibration control systems used with musical instruments.

BACKGROUND

Musicians have long sought to produce sustained sounds on stringed instruments such as the guitar that are not designed to be played with a bow. Today many musicians also desire a wider range of tonality and character than traditional instruments provide. Musicians are also interested in using existing instruments in new ways and in experimenting with entirely new musical instruments. These interests of musicians are being addressed by the music manufacturing industry in part by the creation of new musical instruments and by the evolution of traditional instruments often through the addition of electronics.

SUMMARY OF EMBODIMENTS OF THE INVENTION

In some embodiments, a handheld device for controlling a vibration of a resonant musical member of a musical instrument includes a handheld housing; at least one transducer on the housing that is configured to sense a proximity and/or vibration of a resonant musical member and output an actuating vibratory electromagnetic force based on the vibration of the resonant musical member; and a haptic component on the housing that is configured to output a tactile feedback responsive to a location and/or vibration of a resonant musical member.

In some embodiments, the haptic component comprises a bioelectrical tactile feedback component that applies electrical stimulation to a user's hand or finger to convey information to the user, and the tactile feedback comprises the electrical shocks.

In some embodiments, the haptic component is at least one of a piezoelectric bending actuator, a linear resonant actuator, a motor driven actuator configured to generate a vibration within the housing having an amplitude and/or frequency that is discerned as tactile feedback by the user or a combination thereof.

In some embodiments, the device includes a proximity sensor comprising an optical emitter and detector configured to detect the position and/or vibration of the resonant musical member.

In some embodiments, the device includes a proximity sensor comprising an ultrasonic emitter and detector configured to detect a position and/or vibration of the resonant musical member.

In some embodiments, the device includes an electromagnetic unitary transducer circuit that alternates between sensing and actuating to provide a piecewise approximation to continuous collocated control of resonant musical member vibration; and a control circuit configured to calculate the actuating force according to past sensing data of resonant musical member vibration.

In some embodiments, the device includes a speaker on the housing configured to audibly reproduce signals derived from the sensing of a vibration of a resonant musical member.

In some embodiments, the device includes a control circuit configured to control the transducer and/or haptic component; and a pressure sensing component that outputs a control signal responsive to pressure applied to the housing, the control signal being received by the control circuit and configured to control the transducer and/or haptic component. The control signal responsive to pressure applied to the housing may be configured to control the transducer to generate an electromagnetic pulse that drives vibration of the resonant musical member. The electromagnetic pulse may include a wide spectrum pulse that is configured to cause a vibratory response in the resonant musical member similar to a string being plucked or a resonant musical member being struck by an object.

In some embodiments, the resonant musical member is a string, and the housing comprises an edge portion that is configured to be placed in contact with the string to mechanically terminate a string vibration while the at least one transducer simultaneously actuates the string with the actuating vibratory electromagnetic force.

In some embodiments, the resonant musical member is a string.

According to some embodiments, a handheld device for controlling a vibration of a resonant musical member of a musical instrument includes a housing; at least one transducer on the housing that is configured to sense a vibration of a resonant musical member; a circuit configured to modify the vibration of the resonant musical member to produce a sound signal; and at least one transducer configured to couple the sound signal electromagnetically to a pickup receptor.

In some embodiments, the device includes a circuit configured to receive a measurement of the frequency and/or pitch of vibration of the resonant musical member from the transducer and to generate a pitched and/or harmonized electromagnetic sound signal configured to couple to a pickup receptor.

In some embodiments, the device includes a circuit configured to generate an echo and reverberation sound signal related to vibration of the resonant musical member configured to couple to a pickup receptor.

In some embodiments, the device includes a battery within the housing to store energy and supply electricity to power the device.

In some embodiments, the device includes an inductive charging unit configured to charge the battery comprising a transducer that receives electromagnetic energy from an electromagnetically radiating power source and converts the electromagnetic energy to a voltage and a current; and a diode commutating unit to convey the current to the battery.

In some embodiments, the device includes a speaker on the housing configured to audibly reproduce the sound signal.

In some embodiments, the resonant musical member is a string.

BRIEF DESCRIPTION OF THE DRAWINGS

The accompanying drawings, which are incorporated in and constitute a part of the specification, illustrate embodiments of the invention and, together with the description, serve to explain principles of the invention.

DETAILED DESCRIPTION OF EMBODIMENTS OF THE INVENTION

Figure 1:
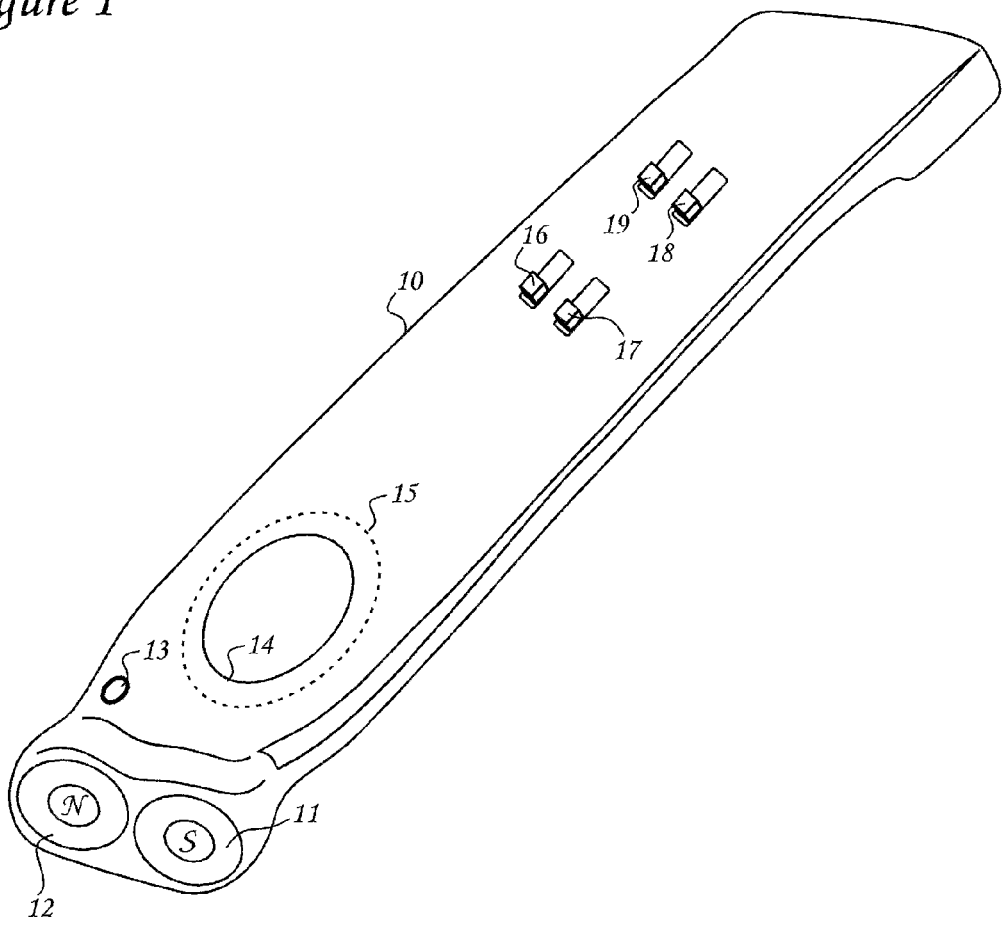
FIG. 1 is a perspective view of a device according to some embodiments.

The present invention now will be described hereinafter with reference to the accompanying drawings and examples, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of "over" and "under." The device may be otherwise oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only unless specifically indicated otherwise.

It will be understood that, although the terms "first," "second," etc. may be used herein to describe various elements, these elements should not be limited by these terms. These terms are only used to distinguish one element from another. Thus, a "first" element discussed below could also be termed a "second" element without departing from the teachings of the present invention. The sequence of operations (or steps) is not limited to the order presented in the claims or figures unless specifically indicated otherwise.

The present invention is described below with reference to block diagrams of methods, apparatus (systems) and/or computer program products according to embodiments of the invention. It is understood that each block of the block diagrams, and combinations of blocks in the block diagrams, can be implemented by computer program instructions. These computer program instructions may be provided to a processor of a general purpose computer, special purpose computer, and/or other programmable data processing apparatus to produce a machine, such that the instructions, which execute via the processor of the computer and/or other programmable data processing apparatus, create means for implementing the functions/acts specified in the block diagrams and/or flowchart block or blocks.

These computer program instructions may also be stored in a computer-readable memory that can direct a computer or other programmable data processing apparatus to function in a particular manner, such that the instructions stored in the computer-readable memory produce an article of manufacture including instructions which implement the function/act specified in the block diagrams and/or flowchart block or blocks.

The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions/acts specified in the block diagrams and/or flowchart block or blocks.

Accordingly, the present invention may be embodied in hardware and/or in software (including firmware, resident software, micro-code, etc.). Furthermore, embodiments of the present invention may take the form of a computer program product on a computer-usable or computer-readable non-transient storage medium having computer-usable or computer-readable program code embodied in the medium for use by or in connection with an instruction execution system.

The computer-usable or computer-readable medium may be, for example but not limited to, an electronic, circuit, electromagnetic, infrared, or semiconductor system, apparatus, or device. More specific examples (a non-exhaustive list) of the computer-readable medium would include the following: a portable computer diskette, a random access memory (RAM), a read-only memory (ROM), an erasable programmable read-only memory (EPROM or Flash memory), and a portable compact disc read-only memory (CD-ROM).

In the following description the term "string" is conveniently used to denote any resonant musical member employed to produce musical sounds within any musical instrument, where the member is directly responsive or may be modified to be responsive to a magnetic force. A tensioned string on a stringed instrument, such as a guitar, harp, violin, viola, cello or string bass, is an example of such a string and has a series of addressable resonances. Another example of a resonant musical member is a wooden marimba block, which may be modified to be responsive to magnetic force by rigidly attaching a small magnetically responsive plate to transmit magnetic forces to the wood.

Referring to FIG. 1, a housing 10 includes transducer coils 11, 12, an indicator lamp 13, a thumb rest area 14, a pressure sensing resistor 15, switches 16, 17, 18 and 19, a power jack, a circuit board 30, a haptic actuator 31, and a power supply or battery 32. The housing 10 may be any suitable size or shape, such as 4 or 5 inches in length, approximately an inch wide and a third of an inch thick, so that the housing 10 is easily held by pinching between thumb and forefinger as though it were a stylus. When so held, the musician's thumb will rest upon area 14 of the housing 10 which may be a button or a bendable feature of the housing 10 configured to transmit the force of the musician's thumb to resistor 15 which is responsive to pressure and may act as a switch or may have a gradient response. Indicator lamp 13 shows when the device is on.

The switches 16, 17, 18 and 19 control the behavior of the device. Switch 16 selects pressure sensing resistor 15 functionality to either produce a gradient response or a switch response to pressure. Switch 17 enables the haptic feedback functionality. Switch 18 selects between two timbres. Switch 19 turns the device off and on. Transducer coils 11 and 12 are deployed at one end of the device at a suitable angle relative to the long axis of the device so as to be easily positioned by hand with the coils parallel to a musical instrument string.

Figure 2:
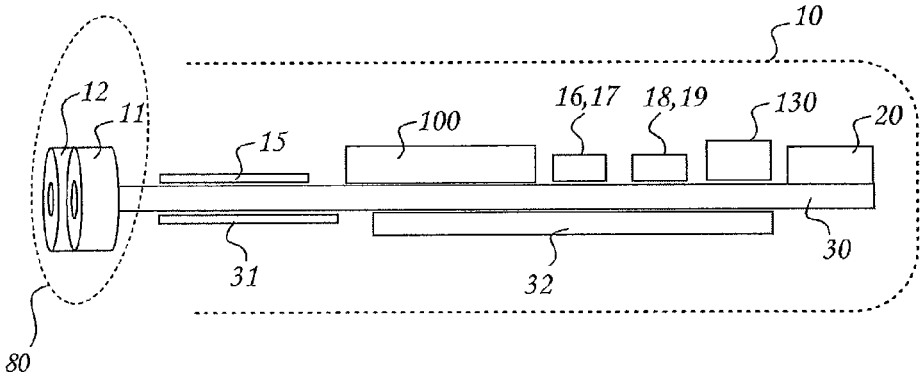
FIG. 2 is a side view of the device of FIG. 1 illustrating the internal components of the device.

Referring now to FIG. 2, components inside housing 10 are shown. Circuit board 30 holds jack 20 for connecting a battery charger, battery 32, pressure sensitive resistor 15, haptic actuator 31, microcontroller 100, wireless transceiver 130, switches 16, 17, 18, 19, and the transducer 80 includes coils 11 and 12. It should be understood that other embodiments may have additional or different sets of components. The general construction includes a single long printed circuit board with various components arrayed upon it, which fits efficiently within the ergonomic stylus-like shape of housing 10.

Figure 3:
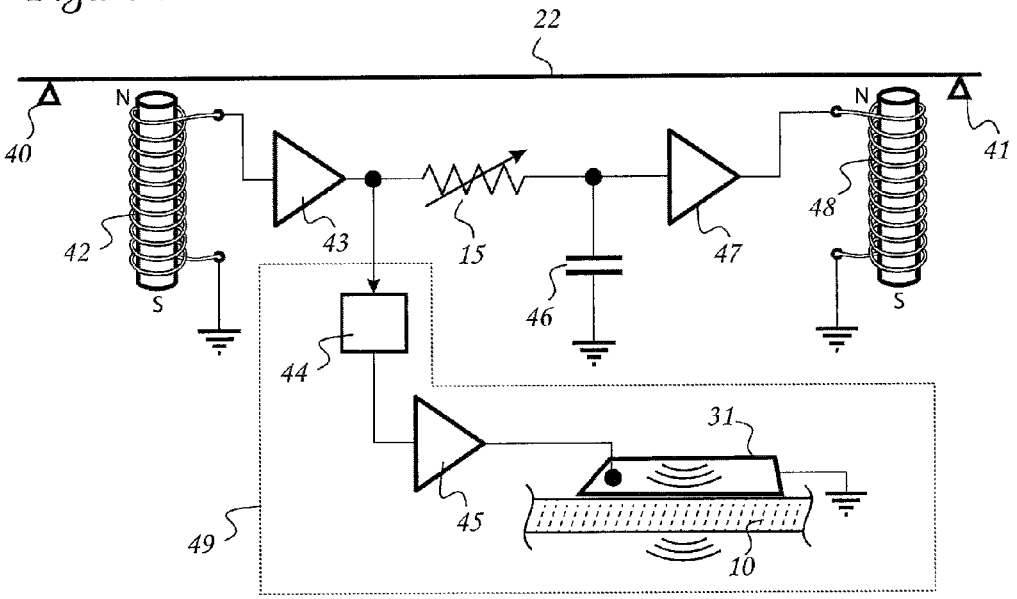
FIG. 3 is a sustainer circuit and a haptic component according to some embodiments.

FIG. 3 is a schematic representation of embodiments that do not rely on the control system of U.S. Pat. No. 6,216,059 and instead employs a conventional sustain circuit. String 22 is shown tensioned between mechanical termination points 40 and 41 and ready to vibrate at musical frequencies. Electromagnetic pickup 42 is responsive to the velocity of string 22 and connects to the input of amplifier 43. A buffer amplifier 43 produces an electrical signal representing the velocity of string 22 as sensed by transducer 42. Pressure sensitive resistor 15 responds to pressure by lowering its resistance value. Resistor 15 and capacitor 46 form a low pass filter having a pole or corner frequency determined by the pressure applied to resistor 15. Driver amplifier 47 is responsive to the filtered voltage on capacitor 46 and drives transducer 48 with sufficient power to excite string 22 to vibration with synchronized electromagnetic forces which while not precisely phase-coherent do still sustain string vibration. Tensioned string 22 is capable of vibrating at several harmonic frequencies determined by integer division of string length. As the user applies pressure on resistor 15, the response of the system increases in frequency and thereby engages progressively higher frequency harmonics on the string. Such a system may not provide precise control of individual harmonic amplitudes, but it can cause the string 22 to sustain and sound with increasingly higher harmonics as greater pressure is applied to resistor 15. This may be useful and expressive in a handheld sustaining device.

FIG. 3 also shows a haptic system 49 where the output of buffer amplifier 43 is connected to a processor 44. The processor 44 is responsive to the buffered string velocity signal from 43 and produces a haptic signal which, once amplified by driver 45, produces the desired haptic behavior of actuator 31. For example, processor 44 may aggressively low pass filter the velocity signal to extract subsonic information indicative of the musician's movement of the device relative to the guitar string while rejecting the higher frequency velocity signal of string vibration. The processor 44 may also include a threshold to transform this subsonic into a forceful click when the subsonic crosses zero. This zero crossing is arranged to occur when the transducer 42 is moved from one side of the string to the other, creating the tactile illusion that the device has physically plucked the string 22 when in fact it has merely moved past the string without actually contacting it. The processor 44 may also simply drive actuator 31 with the signal derived from string 22. Actuator 31 is coupled mechanically to housing 10 and its mechanical impulses and vibrations propagate through the housing to the musician's fingers thus providing tactile feedback. The strength of this tactile feedback may be made to vary in proportion to the distance of the transducer 42 from the string 22 such that with some experience the user will be able to tell by feeling when he or she has moved the transducer sufficiently close to the string to produce sustain and/or harmonic effects upon it without having to rely on either vision or muscle memory. Actuator 31 is shown as a piezoelectric bending actuator but it is to be understood that other known haptic actuators can be used instead, notably an eccentrically weighted rotary motor actuator or a linear resonant actuator. This haptic system 49 includes the processor 44, driver 45 and haptic element 31 coupled to the housing 10, and may be used in any of the embodiments and it should not be construed as being limited in application to the conventional sustainer topology illustrated in FIG. 3.

Figure 4:
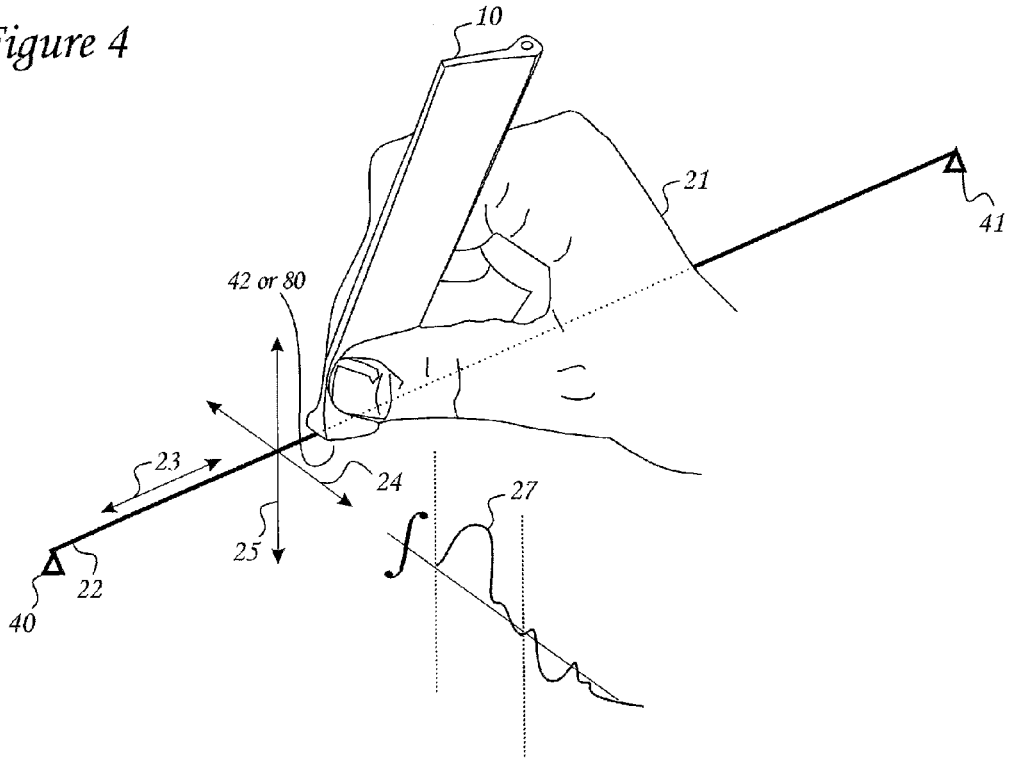
FIG. 4 is a perspective view of the device of FIG. 1 in use with a string.

Reference is now made to FIG. 4 which shows the housing 10 of the device held in musician's hand 21 and applied to string 22. Explanation is made here with reference to pickup transducer 42 but applies equally well to unitary transducer 80 as described herein. The string signal detected by transducer 42 includes a velocity signal derived from the vibration of string 22 superposed on a subsonic component of velocity, said subsonic component being due to the motion of transducer 42 relative to string 22 occurring when a user moves the device into operating position. Transducer 42 has a position on a plane defined by vector 24 and 25. Movement of transducer 80 on this plane generates a velocity signal and integrating this velocity signal recovers a 'position' signal 27 responsive to the position of transducer 42 relative to the string. In some embodiments, this position signal controls selectable parameters such as control loop gain or the spectrum of string vibration. The user experiences this as an audible changes in the character of string vibration responsive to changes in motion and position of housing 10.

Referring again to FIG. 4, in some embodiments, when the haptic element 31 is swept side to side past string 22 along axes 24, the haptic element 31 may produce tactile sensation in a manner the musician interprets as feeling the string 22 passing underneath transducer 42 as though it were plucked by a plectrum. Various other haptic responses are possible and are within the scope of the invention.

Referring again to FIG. 4, it is noted that such a handheld device allows the user to deploy the device anywhere along the length of string 22. By moving the point of control to varying distances from string termination point 40 along the axis 23 of string 22, the user can select different sets of harmonics for sustain or control.

Figure 8:
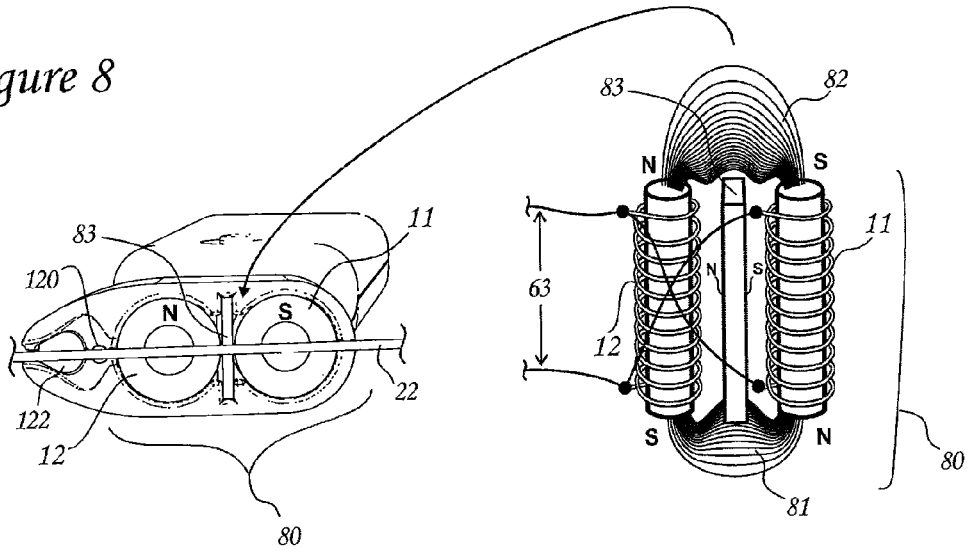
FIG. 8 is a schematic diagram of the transducers of the device of FIG. 1

Briefly referring to FIG. 8, in some embodiments, transducer coils 11 and 12 are deployed at one end of the device at a suitable angle relative to the long axis of the device so as to be easily positioned by hand with the coils parallel to a musical instrument string. Two coils, coil 11 and 12, are used to form transducer 80. The windings of the coils 11 and 12 may be identical, but the polarity of the magnets may be opposite. The coils 11 and 12 may be wired in reverse series or in reverse parallel as illustrated. With the windings coupled in reverse and the magnetic polarity also reversed, the velocity signal developed due to vibration of a proximate guitar string is in-phase and additive on both coils while external interference signals such as electromagnetic power line hum are coupled in reverse phase and thus greatly reduced by cancellation. This configuration may be referred to as a "humbucking" pickup. A corresponding advantage may exist when driving transducer 80 with an actuating signal for modifying string vibration due to the electromagnetic field emitted by the one coil being out of phase with the electromagnetic field emitted by the other coil. In near proximity (e.g., contactless proximity) such as close to a guitar string the electromagnetic field coupling is reinforced and the transducer couples to the string with better authority, but as the distance from the transducers increases, the opposing propagated fields cancel each other greatly reducing any electromagnetic interference emitted by the device. It should be understood that in the drawings a single coil transducer 42, 48, 60 or 70 is shown for simplicity but it is to be understood that in embodiments these instances may be replaced by transducer 80.

Figure 5:
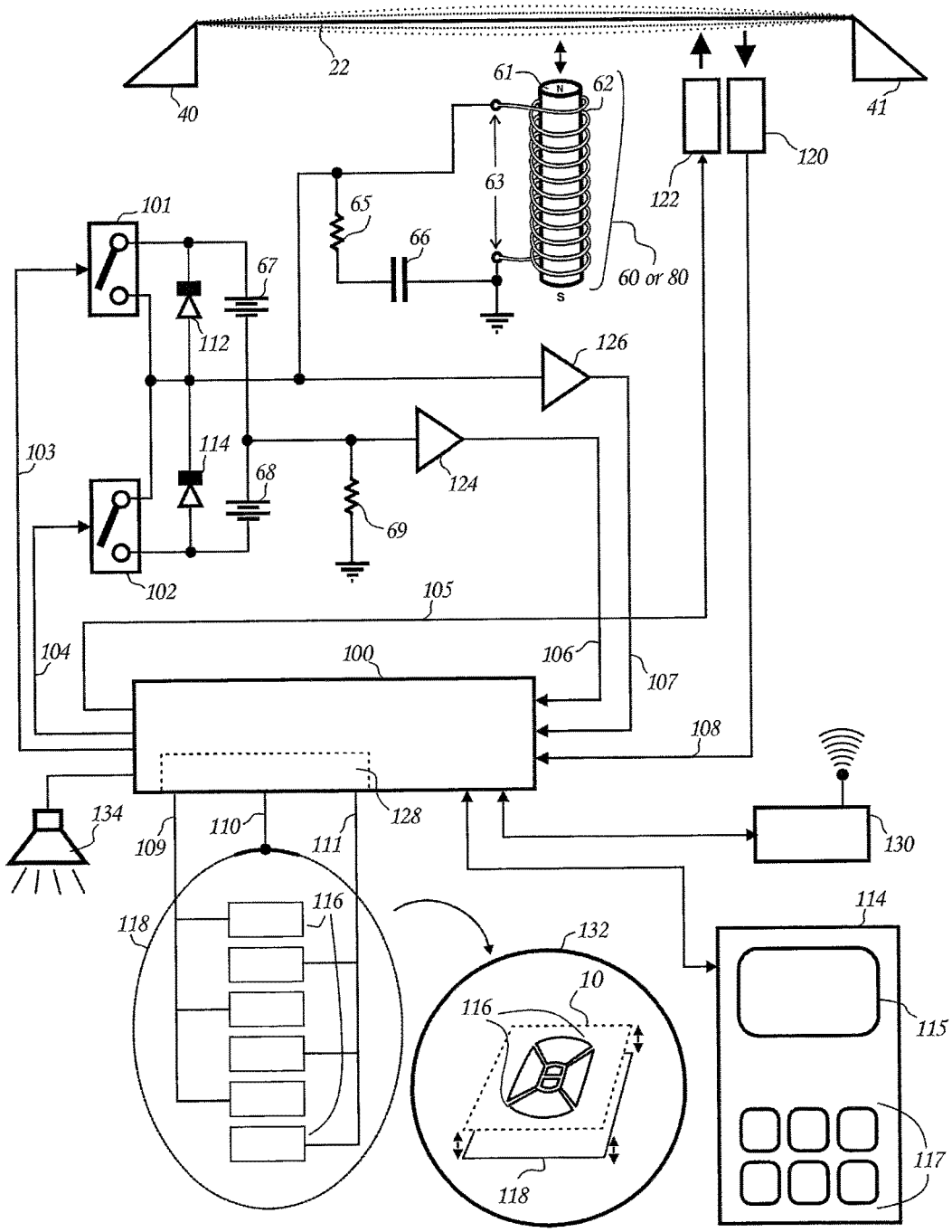
FIG. 5 is a circuit diagram according to some embodiments.

Referring now to FIG. 5, robust and precise vibration control may be provided by the unitary transducer control apparatus and method whereby a single transducer rapidly alternates between sensing and actuating to provide a piecewise approximation to continuous collocated control. The control system of U.S. Pat. No. 6,216,059 controls string vibration through the application of synchronized and phase-coherent electromagnetic forces. This is a true control system that can both promote and inhibit string vibration and even excite one harmonic of vibration while simultaneously damping another. Conventional sustainers are capable only of exciting vibration but not damping vibration. The detailed operation of this control system may be understood by referring to the description and drawings of U.S. Pat. No. 6,216,059, the disclosure of which is hereby incorporated by reference in its entirety.

FIG. 5 illustrates embodiments incorporating a microcontroller 100 to generate timing signals, perform calculations and interpret user commands. Unitary transducer 60 includes a magnet 61 and a coil 62, and generates a voltage 63 proportional to the velocity of the string 22 during a sensing interval and during an actuating interval produces a magnetic pulse driven by switching devices 101 and 102 that delivers a force to string 22. Snubber resistor 65 and capacitor 66 prevent ringing of the circuit.

Voltage 63 across transducer 60 is conditioned by buffer 126 while the current through transducer 60 is expressed across resistor 69 and conditioned by buffer 124. Conditioned signals 107 and 106 are presented to microcontroller 100. Monitoring current in transducer 60 enables a range of sophisticated driving methods for driving the bridge comprised of electronic switches 101 and 102. Microcontroller 100 drives the bridge by controlling the timing of switch control lines 103 and 104. In many embodiments a full-bridge drive circuit may be employed here although a half bridge is shown in FIG. 5 for simplicity.

Microcontroller 100 also modulates emitter 122 and receives a reflected signal from detector 120, using the reflected signal to detect the device's proximity to string 22 which need not be vibrating for detection to take place. Tactile feedback is most effective when the musician can feel the device approaching a string even before the string begins vibrating and this auxiliary string detection provides this proximity information without contact with the string. Moreover, as vibration is a variation in proximity, the emitter detector pair of 122 and 120 can also detect string vibration and this is useful to certain algorithms that may be executed by microcontroller 100.

Microcontroller 100 is connected to peripheral wireless transceiver 130 for network communication of data. Said data may be user commands, predetermined configurations of microcontroller 100 functionality, firmware updates, real-time audio. etc. Microcontroller 100 is connected to user interface 114 which may include a local graphical display and a series of touch pads or touch gradient controls. User interface 114 may be deployed on a face of the device normally visible to the user. Microcontroller 100 may also drive loudspeaker 134, which being a bidirectional transducer as all voice coils are may also be a microphone. Accordingly, in some embodiments the device can play sounds audibly and even record vocalizations or ambient sounds for creative effects.

Microcontroller 100 is also provided with a haptic actuator 116 integrated with a pressure sensor 118. In this embodiment, haptic actuator 116 is a bioelectrical actuator that produces a substantially tactile sensation by running an electrical current for short distances across the pad of a user's thumb or finger while it is pressed against a set of electrically conductive elements 116 which are driven to a suitably high-voltage by means of a capacitive voltage multiplier circuit 128. The elements 116 are interleaved with half being driven negative by line 109 while the other half are driven positive by line 111 resulting in enough voltage and current through the user's skin to provide a noticeable but not unpleasant sensation. Microcontroller 100 controls the timing, duration and intensity of this bioelectrical haptic effect and therefore how it is perceived by the musician. A variety of useful perceptions may be created.

In some embodiments, the haptic method and apparatus does not create actual vibrations in the body of the device, a significant advantage over haptic systems that do create such vibrations because real mechanical haptic vibrations may be audible and may conflict with the musical sounds being generated by the device upon a musical instrument string. Bioelectrical tactile feedback is a silent and a very effective haptic indicator in some embodiments.

Pressure sensor 118 includes a conductive backplane interface to microcontroller 100 at node 110. As shown in the insert, bioelectrical haptic array 116 is deployed on a surface of the device housing 10 which is conditioned to be sufficiently elastic to be slightly deformed by the user's application of finger pressure. Thus pinching the housing between thumb and fingers brings the electrical elements 116 physically closer to backplane 118. The resulting change in capacitance is sensed by microcontroller connection 110 and interpreted as a user control signal for controlling real-time parameters of the device.

In some embodiments, the microcontroller 100 runs a firmware program or selection of firmware programs capable of realizing all of the functions, aspects and embodiments described herein.

It is possible to detect proximity to the string without relying on a velocity signal from the control system. Referring again to FIG. 5, one such technique would be that of optical sensing of the string by LED or laser reflection as illustrated by optical emitter 122 and optical detector 120. Sensing the string by the reflection of an ultrasonic vibration in the manner of sonar is an alternate means, in which case 122 is an ultrasonic loudspeaker transducer and 120 is an ultrasonic microphone arranged to detect ultrasonic reflections of the signal from emitter 122. Such an ultrasonic transducer is detailed in U.S. Pat. No. 9,117,428, the disclosure of which is incorporated by reference in its entirety. All such means employed to sense the position of the string relative to the handheld device are within the scope of this invention.

Figure 6:
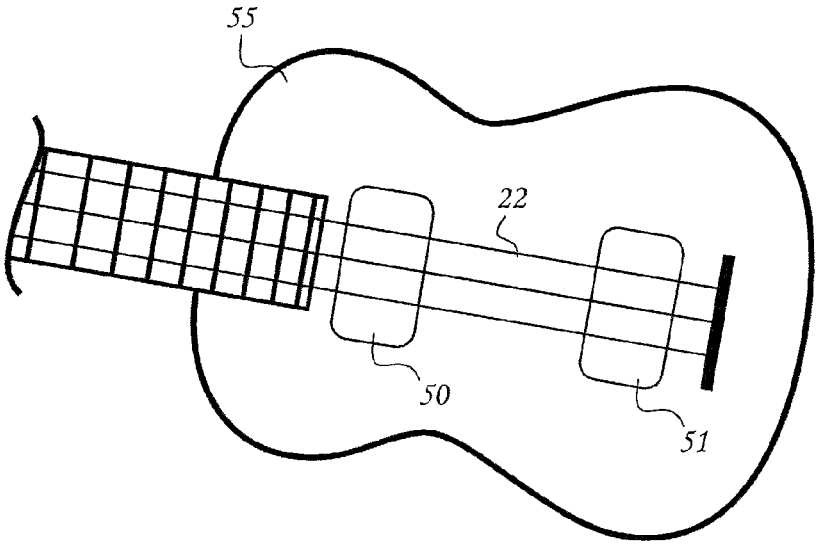
FIG. 6 is a schematic diagram of the device of FIG. 1 in use with a guitar string on a guitar.
Figure 6:
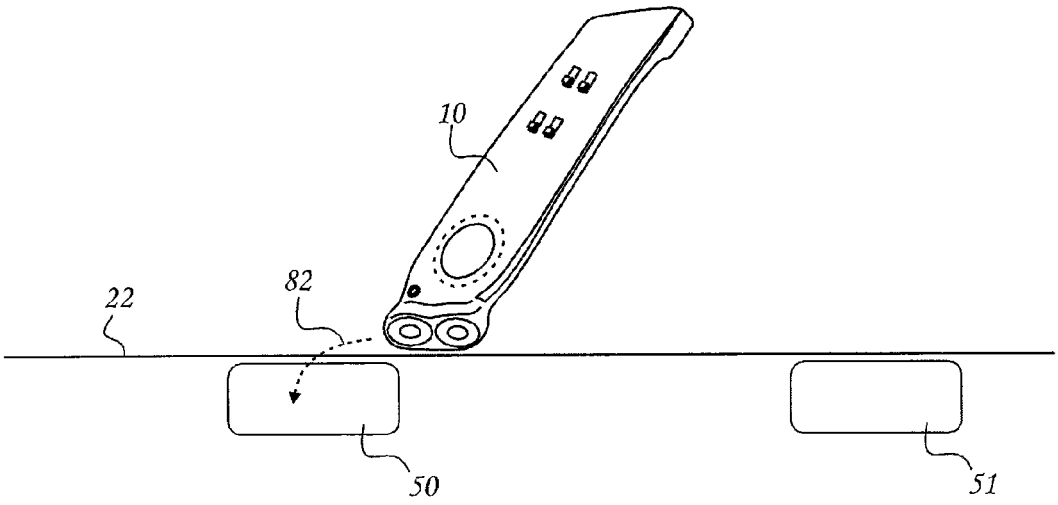

Reference is now made to FIG. 6 which shows a guitar-like instrument 55 having strings 22 and electromagnetic pickups 50 and 51. Beneath this drawing the same essentials are shown more abstractly, with the device positioned to control the vibration of string 22 and to inject an electromagnetic signal 82 directly into pickup 50 of guitar 55. The electromagnetic drive signal 82 will always couple to a proximate electromagnetic guitar pickup and this may be exploited to musical advantage by making the signal 82 musically interesting. For example, microcontroller 100 may measure the pitch of string 22 and drive transducer 60 to emit an electromagnetic signal 82 that includes a pitched drive signal in phase with the string velocity to sustain the vibration of the string and also includes a simulated echo, reverberation or replay of previous notes played on the string that will be received by a guitar pickup and/or broadcast from loudspeaker 134.

Alternatively or additionally, string vibration may be driven by a series of impulses generated by the transducer 80 and synthesized to represent the string being hammered or rapidly and repeatedly plucked by a plectrum. An idle string in a resting state may be made to quickly vibrate by applying an impulse analogous to a single pluck or hammer strike, which would not only be heard via direct electromagnetic coupling to the pickup but would also have the actual effect of initiating vibration on the string just as would a real hammer strike or plectrum pluck. The musician may control the onset of the impulse by pinching pressure sensor 118, which sends a control signal to the microcontroller 100, which controls the transducer 80 to generate an impulse to control the string. This constitutes a desirable device behavior that may be described as an 'electromagnetic plectrum' functionality. A signal suitable for this functionality will have a spectrum sufficiently broad to excite at least one resonance mode of the resonant musical member or string; examples include but are not limited to a simple impulse sounding like a click, a burst of white noise and a signal similar to noise but sounding like a burst of breath, such signal being analogous to how a tone is started from a flute by a flutist.

One of the aspects of U.S. Pat. No. 6,216,059 is measurement of the pitch of a vibrating string calculated from a signal representing the string velocity. A series of samples representing a musical note according to the pitch of string is emitted from the transducer whenever the transducer is maneuvered close enough to a musical instrument string to measure its pitch. When the transducer is also sufficiently close to an electromagnetic instrument pickup such as that of a conventional electric guitar, this emitted electromagnetic signal is coupled into the pickup of said electric guitar and appears at its signal output much as if it were generated by the strings themselves. A synthesized or prerecorded sound sample may thus be injected through the pickup system of the guitar, said sound bearing a predetermined relationship to the pitch of the string such as an octave or other harmony. The musician may use the device to inject a synthetic sound into the normal sound output of the instrument while manually choosing which string will define the pitch of said sound.

Any sound imaginable that can be recorded as a series of samples can be played back this way through the electromagnetic pickups of an electric guitar. A chord can be struck upon a guitar for example, and then the device may be brushed across the strings, accenting each note of the cord and reinforcing each note in succession with a superposed synthesized or recorded sound such as a flute sound or with a processed version of the string vibration itself, where such processing may include any or all of echo, reverberation, phasing, flanging, distortion, or even modeling such as the well-known COSM modeling system by Roland Inc. The electrical output of instrument 55 may thereby includes the actual string sound as sensed conventionally by the guitar's pickups superposed with a synthesized sound and augmented with reverberation and echo. The advanced user interface 114 illustrated in FIG. 5 will be useful to the musician in governing this capability, as will the wireless transceiver as it may, in some embodiments, allow microcontroller 100 to accept behavioral scripts and commands stored remotely.

In some embodiments incorporating a conventional sustainer such as that of FIG. 3, the injection of recorded or synthesized sounds into an instrument's electromagnetic pickups may also be performed. It may not be necessary to have a sustainer operable in conjunction with the device for the injection feature. In some embodiments, the device passively measures the pitch of the vibrating string and emits a synthesized or recorded signal according to the measured pitch. The emitted signal is the output of the device and is injected directly into the pickups of an instrument equipped with pickups. The signal may also be accessed through wireless transmission.

Figure 7:
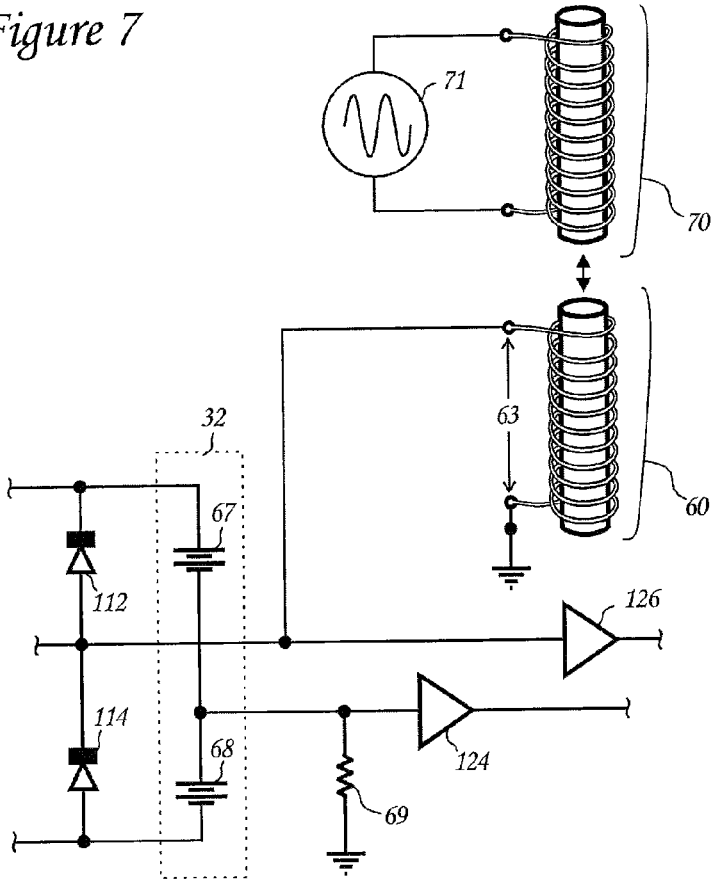
FIG. 7 is a circuit diagram illustrating inductive charging of a battery of the device of FIG. 1

Reference is now made to FIG. 7, which shows a wireless charging circuit. In most embodiments a battery may be necessary to provide power to the device. It is convenient to have the power source self-contained within the device. Such a battery is preferably a rechargeable battery. To charge the battery a wire providing power could be connected to the device via jack 20. Making brief reference to FIG. 2, in some embodiments, a flat lithium-ion polymer battery 32 is deployed in parallel with the circuit board 30 of the device. This battery 32 may be charged through inductive coupling of energy from a charging stand represented by charging transducer 70 and power source 71.

As illustrated in FIG. 7, charging transducer 70 driven by a suitable voltage waveform 71 powered from the AC line or other external source. Charging transducer 70 is inductively coupled to transducer 80 of the device. The charging coil 70 couples electromagnetic energy into the transducer 60—the same transducer used to operate the device on a string. Within the device, catch diodes 112 and 114 steer this current into a battery 32 comprised of cells 67 and 68 thus charging the battery and providing a diode commutating unit. Although the charging process may be entirely passive, microcontroller 100 may be operational and mat signal charger 70 when charging is complete.

As shown in FIG. 8, in some embodiments a flat rectangular ferrite magnet 83 magnetically polarized north and south on its flat faces is deployed between the coils 11 and 12 of a composite transducer 80. This improves the performance of transducer 80 by bending the magnetic field 82 outward on the end of the transducer used to actuate guitar strings while concentrating and confining magnetic field 81 on the unused opposite end of transducer 80. This increases the useful physical range of the device relative to the guitar string and makes it somewhat easier to position properly.

FIG. 8 also shows a bottom view of the device as seen from below musical instrument string 22. LED light emitter 122 is visible as is the working end of unitary transducer 80. The optical sensor 120 is also visible. The string 22 may be coupled when it is positioned down the center of both magnets of transducer 80. Vibration of string 22 gives rise to a velocity voltage 63 as it does with single coil transducers.

Figure 9:
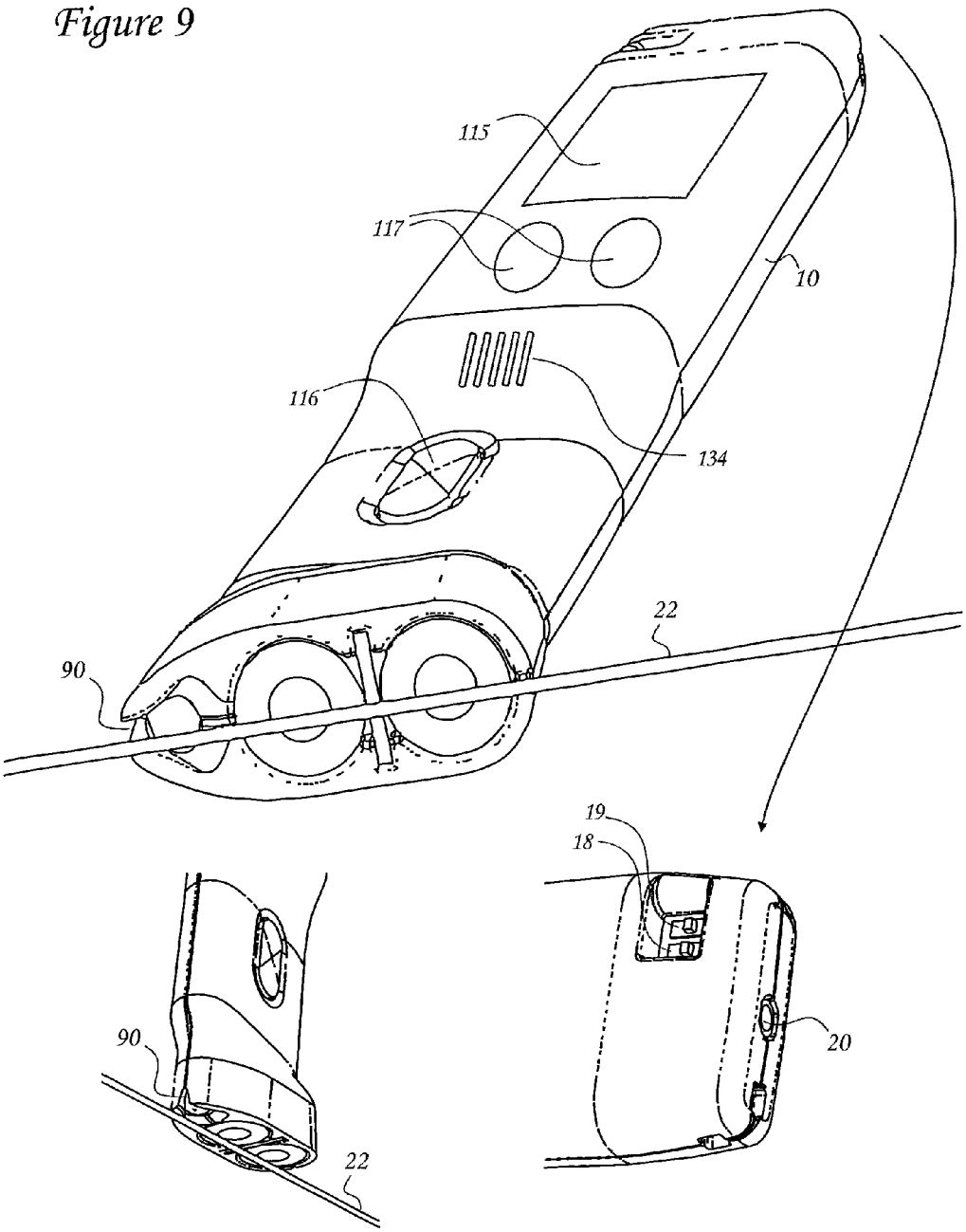
FIG. 9 is a perspective view of the device of FIG. 1 in use with a string and illustrating features on an exterior portion of the housing.

FIG. 9 illustrates pictorially the embodiment shown schematically in FIG. 5. Graphic display 115 and touch switches 117 are shown mounted to the housing in a suitable position to be visible to the musician. Switch 19 and 18 enable power and haptic action. Charger jack 20 is also shown. An acoustically porous grating behind which is loudspeaker 134 as shown. Bioelectric haptic component 116 is shown deployed where the musician's thumb would be when gripping the housing. An auxiliary electrode may also be provided on the back of the housing to facilitate current flow between thumb and fingers to produce stronger haptic effects. An orientation of the device towards string 22 favorable for driving the string into vibration is shown. The drawings of FIG. 9 are intended to show the appearance of a possible commercial embodiments and to show how everything described herein can be practically made to fit on a hand-held housing.

Figure 10:
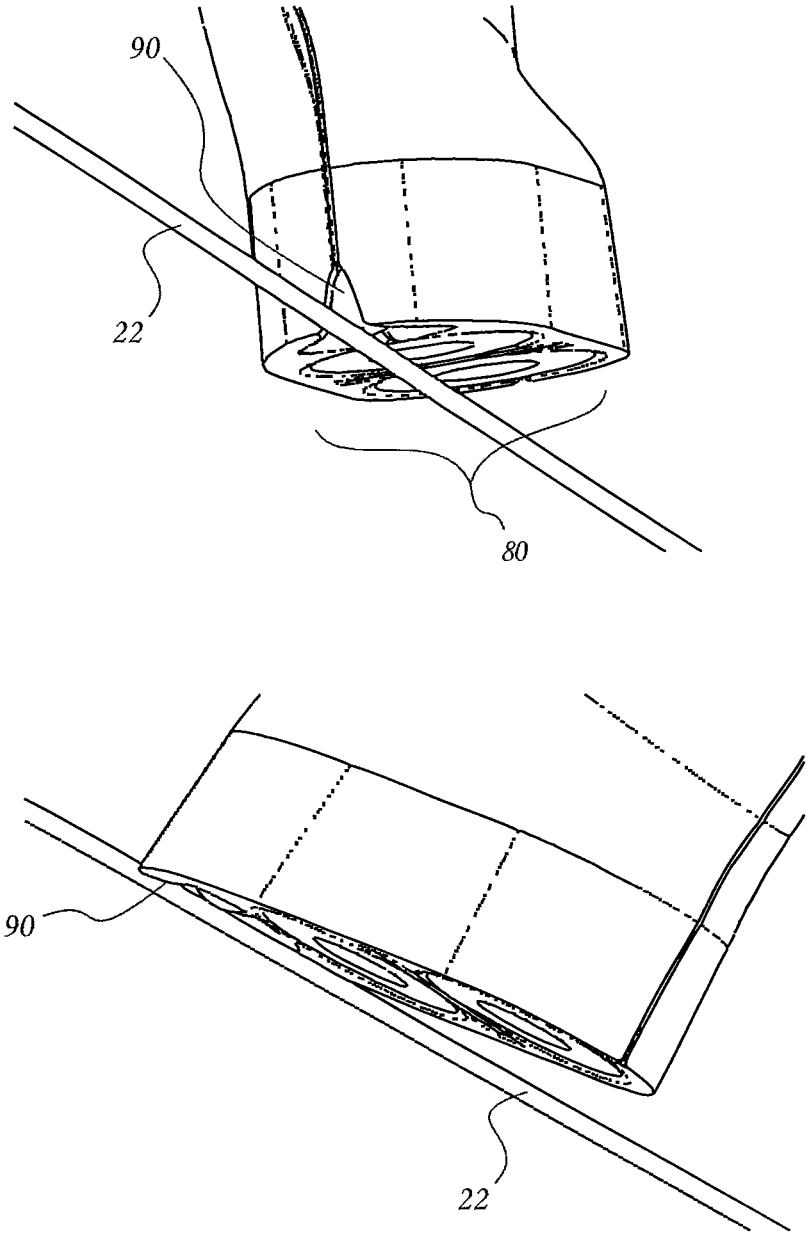
FIG. 10 is a perspective view of the device being used as a slide on the string to set pitch and simultaneously control string vibration.

In some embodiments, a saddle feature or notch on the housing 10 may include an edge portion that is used to touch the string and terminate string vibration at this point of termination thus determining the pitch of the string. FIG. 10 illustrates an embodiment being used to both terminate a string and drive string vibration. A saddle feature 90 is placed in contact with string 22 and terminates string vibration similarly to a fret or a bottle slide when applied to a string. The saddle feature 90 may be slid or positioned anywhere along the string and the pitch of the string will be determined by this position. The transducer 80 is positioned adjacent the string and drives string vibration as it does in other embodiments but in this embodiment the result is that the device simultaneously drives the string and sets it's pitch. This feature may be described as a 'powered slide' capability.

Although the device is primarily intended to be operable by the hand of the musician it may of course be deployed in any other manner for any purpose that makes use of its facilities. For example, a number of such devices may be deployed on the individual strings of a piano in a fixed array and controlled wirelessly. In another example deployment, small pieces of ferrite are glued to one or more wine glasses and coupled to the transducers of the device which drives the glasses to sing at their natural resonant frequency. Other applications of the device are possible and all fall within the scope of this patent.

Some embodiments of the present invention provide a hand-held device for playing an instrument usable on many different instruments, a device producing novel musical effects on any instrument having one or more resonant musical members directly or indirectly responsive to magnetic force, including but not limited to the steel stringed guitar, harp and piano, instruments with steel tines such as the thumb piano, vibraphones, musical bowls such as the steel drum or steelpan and the Hang or generic handpan.

According to embodiments of the present invention, a device for exciting and/or controlling and/or modifying vibration of a resonant musical member may be provided. The device may include a housing that may be adapted to be held in the hand between thumb and forefinger much like a stylus or a musical plectrum. The device may include one or more transducers configured to apply vibratory electromagnetic force to a musical member and may employ the same or different transducers to sense the vibration and monitor the proximity of the musical member. A pressure sensitive element may be operable to govern selected aspects of the behavior of the device. One or more switches may be operable to enable or modify modes of device operation. A haptic component may be provided to generate tactile feedback for the musician, the tactile feedback being indicative of the proximity of the transducer(s) to the resonant musical member and the degree of its vibration. The tactile feedback may assist the musician in positioning the handheld device for coupling to the resonant musical member. A lamp may be provided to illuminate the resonant musical member and its illumination may be a strobe modulated in intensity and color according to vibration of the musical member to assist and/or entertain the musician and audience. The lamp may also serve as an emitter for detecting a proximate musical member.

In some embodiments, a microcontroller computing component or processor may be provided having firmware and a digital signal processor capable of realizing the facilities of an electronic music system in real-time. The microcontroller may be responsive to switches. A pressure sensitive element and one or more transducers may be used that have an output for driving a haptic component. A lamp may be mounted on the housing to illuminate a resonant musical member, and transducers may be used to apply vibratory magnetic force to the musical member. The microcontroller may include memory and firmware to perform general signal processing functions and functions described herein.

In some embodiments, the microcontroller may connect to a wireless data transceiver also located within the housing.

In some embodiments, the microcontroller may connect to a user interface peripheral that may have a visible graphic or alphanumeric display and/or touch switches and may be positioned on the housing for interaction by the musician. A small loudspeaker may also be included within the housing to render some signals within the device audible to the musician and this loudspeaker may also be used as a microphone allowing the musician to vocalize audio commands or data into microcontroller.

In some embodiments, a battery may be provided within the enclosure to supply power to the device. A charging port may be provided for charging the battery.

In further embodiments of the present invention, the device is placed upon a charging stand to charge its internal battery. The charging takes place via inductive coupling without the need of an explicit electrical connection to the device.

Some embodiments utilize a control system, such as the control system described in U.S. Pat. No. 6,216,059 which is included herein in its entirety by reference. The control system of U.S. Pat. No. 6,216,059 specifies apparatus and methods for controlling the amplitudes of individual harmonic components of vibration as well as the overall amplitude of vibration to define and modify the timbre of sound heard from a string or other resonant musical member.

In some embodiments, the pressure sensitive element may be a force sensing resistor with resistance responsive to the pressure applied by the musician between thumb and forefinger as the device is held.

In some embodiments, the pressure sensitive element may be a variable capacitor with capacitance responsive to the pressure applied by the musician between thumb and forefinger as the device is held.

In some embodiments, the haptic component may include one of a piezoelectric bending actuator, a rotary motor having an eccentric weight and a linear resonant actuator (LRA) motor, any of which may provide tactile feedback in the form of a physical vibration or impulse transmitted mechanically through the housing to the musician's fingers.

In some embodiments, the housing of the device may have electrical contacts arranged where the housing is gripped, the contacts being configured for electrical connection to the fingers and/or thumb of the musician, and the haptic component may be a bioelectric stimulator that emits small controlled electric shocks to produce the sensation of a vibration or impulse on the pad of a finger or across finger and thumb. This bioelectric type of haptic component does not produce an actual vibration and therefore achieves its purpose with no audible artifacts, which may interfere with musical sounds.

Some embodiments may include a method of detecting a resonant musical member with a transducer, measuring the proximity of the member to the transducer and reducing the measured proximity to a proximity control signal for controlling tactile feedback to the musician, the tactile feedback having thereby a discernibly different characteristic or gradient depending on the proximity thus enabling the musician to adjust by tactile sensation the position of the device's transducer to be very close to but not actually touching the vibrating member.

Some embodiments may include a method of making the tactile feedback feel as though the magnetic field of the transducer(s) were physically contacting the musical member. As the musician swipes the device past a musical instrument string or musical member a tactile impulse may be felt as the magnetic field emanating from the device passes across the string. The sensation may be as though the magnetic field was the physical end of a plectrum plucking the string although no physical contact takes place.

A further embodiment may include a method of using the proximity control signal to alter operating parameters of the control system such as modifying the harmonics selected for control, thereby enabling the musician to adjust timbre according to the position of the transducer relative to the vibrating musical member.

Some embodiments may provide a method of measuring the pitch of the vibrating musical member being addressed by the device. The measured pitch may be reduced to a general purpose control signal that may be continuous or quantized into steps and may be applied to alter any parameter of an electronic music system such as the pitch of a synthesized musical signal, a filter tuning, a selection of a particular timbre spectrum from a set of spectra, an amount of echo or reverberation, etc.

Some embodiments may provide a method of augmenting the sound of an instrument having electromagnetic pickups such as a guitar by injecting an electromagnetic audio signal directly into the pickups. The sound signal may be propagated electromagnetically from the transducers of the device over a short distance sufficient for coupling to an electromagnetic pickup. In operation, the musician may address a musical member of his instrument by maneuvering the device to a position close to both the member and to the instrument's electromagnetic pickup. The transducer of the device may emit an electromagnetic sound signal that is coupled to the instrument's electromagnetic pickup. A voltage analog of said sound signal may thus be produced across the coil of the instrument's electromagnetic pickup and output from the instrument's output jack as though it were a signal originating on the vibrating musical member itself. The instrument's output jack may thereby carry a composite signal having a first component originating at the vibrating member via the instrument's electromagnetic pickup and a second superposed component originating from the transducer(s) of the device. The two signals may be substantially identical or different. The second signal may in unison or in harmony with the first signal. The second signal may have completely different timbre from the first signal; it may be any sampled, synthesized or otherwise electronically produced signal or it may be modified from the musical member's vibration. The second signal may be an echo or a reverberation of the vibration of the musical member, or a recording of past notes played on the musical member, etc. All of these and more possibilities may have useful musical purpose for the musician.

In some embodiments, a method of initiating and/or driving vibration of the resonant musical member consists of applying an electromagentic pulse or burst of noise having a wide spectrum and causing a vibratory response similar to a string being plucked or a member being struck by a hammer In some embodiments the device housing has a saddle feature shaped to be placed into contact with the string to mechanically terminate the string vibration for setting the length of string under vibration and therefore the pitch of the string vibration.

In some embodiments a method of using the device consists of touching a saddle feature of the housing to a string to set the length of the string and driving the set length of string with electromagnetic forces to initiate and/or modify vibration of the set length of string.

The foregoing is illustrative of the present invention and is not to be construed as limiting thereof. Although a few example embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A handheld device for controlling a vibration of a resonant musical member of a musical instrument, the device comprising:

a handheld housing;

at least one transducer on the housing that is configured to sense at least one of a proximity and vibration of a resonant musical member and to apply an actuating force to a resonant musical member based on the vibration of the resonant musical member;

a haptic component on the housing that is configured to output a tactile feedback responsive to a at least one of a proximity and vibration of a resonant musical member.

2. The device of claim 1, wherein the haptic component comprises a bioelectrical tactile feedback component that applies electrical stimulation to a user's hand or finger to convey information to the user, and the tactile feedback comprises the electrical stimulation.

3. The device of claim 1, wherein the haptic component is at least one of a piezoelectric bending actuator, a linear resonant actuator, and a motor driven actuator, and is configured to generating a vibration that is discerned as tactile feedback by the user or a combination thereof.

4. The device of claim 1, further comprising an optical sensor comprising an optical emitter and detector configured to detect the at least one of a proximity and vibration of the resonant musical member.

5. The device of claim 1, further comprising an ultrasonic emitter and detector configured to detect at least one of a proximity and vibration of the resonant musical member.

6. The device of claim 1, further comprising an electromagnetic unitary transducer circuit that alternates between sensing and actuating to provide a piecewise approximation to continuous collocated control of resonant musical member vibration; and a control circuit configured to calculate the actuating force according to past sensing data of resonant musical member vibration.

7. The device of claim 1, further comprising a speaker on the housing configured to audibly reproduce signals derived from the sensing of a vibration of a resonant musical member.

8. The device of claim 1, further comprising:

a control circuit configured to control at least one of the at least one transducer and the haptic component; and a pressure sensing component that outputs a control signal responsive to pressure applied by the user to the housing, the control signal being received by the control circuit and configured to control the at least one of the at least one transducer and haptic component.

9. The device of claim 8, wherein the control signal responsive to pressure applied to the housing is configured to control the transducer to generate an electromagnetic pulse that drives vibration of the resonant musical member.

10. The device of claim 9, wherein the electromagnetic pulse comprises a wide spectrum pulse that is configured to cause a vibratory response in the resonant musical member similar to a string being plucked or a resonant musical member being struck by an object.

11. The device of claim 1, wherein the resonant musical member is a string, the actuating force is an actuating vibratory electromagnetic force, and the housing comprises an edge portion that is configured to be placed in contact with the string to mechanically terminate a string vibration while the at least one transducer simultaneously actuates the string with the actuating vibratory electromagnetic force.

12. The device of claim 1, wherein the resonant musical member comprises a musical instrument string.

13. The device of claim 1, wherein the at least one transducer on the housing that is configured to sense at least one of a proximity and vibration of a resonant musical member and to apply an actuating force to a resonant musical member are provided by a single, unitary transducer.

14. The device of claim 1, further comprising a circuit responsive to a proximity of the resonant musical member and configured to generate one or more electromagnetic pulses that drive vibration of the resonant musical member to cause a vibratory response in the resonant musical member similar to a string being plucked once or repeatedly, or similar to a resonant musical member being struck by an object once or repeatedly.

15. The device of claim 1, further comprising a circuit responsive to a proximity of the resonant musical member configured to generate one or more electromagnetic noise bursts that drive vibration of the resonant musical member to cause a vibratory response in the resonant musical member, each noise burst having a spectrum similar to a burst of breath initiating a note on a flute.

16. The device of claim 1, further comprising an inductive charging unit configured to wirelessly power the device comprising:

a battery within the housing to store electricity;

a transducer coil that receives electromagnetic energy from an electromagnetically radiating power source and converts it to a voltage and a current; and a circuit to charge the battery using the voltage and the current.

17. The device of claim 16 wherein the transducer that receives electromagnetic energy is the at least one transducer used to actuate the vibrating musical member.

18. A handheld device for controlling a vibration of a resonant musical member of a musical instrument comprising:

a housing;

at least one transducer on the housing that is configured to sense at least one of a proximity and a vibration of a resonant musical member;

a circuit configured to select a signal that is different from the vibration of the resonant musical member as a sound signal from internally stored or generated signals comprising at least one of synthetic impulse signals, noise signals, synthetic sound signals, signals produced by a modeling process, prerecorded signals, phasing signals, flanging signals, reverberation and echo signals in response to at least one of the proximity and the vibration of the resonant musical member; and at least one transducer configured to couple the selected sound signal electromagnetically to a pickup receptor.

19. A handheld device for controlling a vibration of a resonant musical member of a musical instrument comprising:

a housing;

at least one transducer on the housing that is configured to sense a vibration of a resonant musical member;

a circuit configured to modify the sensed vibration of the resonant musical member to produce a sound signal; and at least one transducer configured to electromagnetically couple the sound signal to a pickup receptor, further comprising an inductive charging unit configured to charge the battery comprising:

a transducer that receives electromagnetic energy from an electromagnetically radiating power source and converts the electromagnetic energy to a voltage and a current; and a diode commutating unit to convey the current to the battery.

20. The device of claim 18, further comprising a loudspeaker on the housing configured to audibly reproduce the sound signal.

21. The device of claim 18, wherein the resonant musical member comprises a string.

22. The device of claim 18, further comprising a signal processing circuit configured to set the pitch of the selected sound signal to be different to but in musical harmony with the actual pitch of the vibration of the resonant musical member.

23. The device of claim 18, wherein the at least one transducer configured to couple the selected sound signal electromagnetically to a pickup receptor is also configured to electromagnetically actuate the resonant musical member.

24. The device of claim 18, further comprising an inductive charging unit configured to wirelessly power the device comprising:

a battery within the housing to store electricity; and a transducer that receives electromagnetic energy from an electromagnetically radiating power source and converts it to a voltage and a current; and a circuit to convey the voltage and a current to the battery for charging the battery.

25. The device of claim 18, further comprising a microphone for recording at least one of vocalized commands, vocalized data and ambient sounds into the microcontroller.

* * * * *